US010699617B2

(12) United States Patent
Lee et al.

(10) Patent No.: US 10,699,617 B2
(45) Date of Patent: Jun. 30, 2020

(54) GATE DRIVING CIRCUIT AND ITS DRIVING METHOD, ARRAY SUBSTRATE AND DISPLAY DEVICE

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventors: Yunbok Lee, Beijing (CN); Qianqian Wang, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 8 days.

(21) Appl. No.: 16/101,209

(22) Filed: Aug. 10, 2018

(65) Prior Publication Data

US 2019/0266933 A1 Aug. 29, 2019

(30) Foreign Application Priority Data

Feb. 27, 2018 (CN) ..... 2018 1 0164196

(51) Int. Cl.
*G09G 3/20* (2006.01)

(52) U.S. Cl.
CPC ..... *G09G 3/20* (2013.01); *G09G 2300/0404* (2013.01); *G09G 2310/0221* (2013.01); *G09G 2310/06* (2013.01)

(58) Field of Classification Search
CPC ..... G09G 3/20; G09G 2300/0404; G09G 2310/0221; G09G 2310/06; G09G 3/3677; G09G 3/3266; G09G 2310/0286; G09G 2310/0267; G09G 3/2092; G09G 2300/0408; G09G 2300/0426
See application file for complete search history.

(56) References Cited

U.S. PATENT DOCUMENTS 10,120,475 B2 * 11/2018 Abe ..... G02F 1/134309
2008/0266210 A1 * 10/2008 Nonaka ..... G09G 3/20 345/55
2010/0156947 A1 * 6/2010 Moon ..... G09G 3/3648 345/690
2011/0169793 A1 * 7/2011 Chen ..... G09G 3/3677 345/205

(Continued)

*Primary Examiner* — Jose R Soto Lopez
(74) *Attorney, Agent, or Firm* — Kinney & Lange, P.A.

(57) ABSTRACT

The embodiments of the present disclosure provide a gate driving circuit and its driving method, an array substrate and a display device. The gate driving circuit is configured to drive an irregular-shaped display panel that includes a regular-shaped display area and a first irregular-shaped display area, wherein the gate driving circuit includes a first driving module configured to drive one or more first scan lines in the regular-shaped display area and a second driving module configured to drive one or more second scan lines in the regular-shaped display area; wherein one or more third scan lines are driven by the first driving module or the second driving module, and one or more fourth scan lines are driven by the first driving module or the second driving module.

18 Claims, 8 Drawing Sheets

(56) References Cited

U.S. PATENT DOCUMENTS

2012/0307174 A1* 12/2012 Lee ..... G09G 3/2003 349/54
2013/0088265 A1* 4/2013 Chen ..... G09G 3/3674 327/108
2013/0222357 A1* 8/2013 Tseng ..... G09G 3/20 345/212
2014/0198023 A1* 7/2014 Hsu ..... G09G 3/3674 345/99
2015/0161930 A1* 6/2015 Kim ..... G09G 3/20 345/214
2015/0185520 A1* 7/2015 Xu ..... G02F 1/13306 349/38
2015/0269897 A1* 9/2015 Kitsomboonloha ..... G09G 3/3648 345/205
2015/0287392 A1* 10/2015 Kim ..... H03K 17/693 345/213
2016/0189794 A1* 6/2016 Lou ..... G11C 19/28 345/214
2016/0253950 A1* 9/2016 Ma ..... G11C 19/28 345/100
2016/0349896 A1* 12/2016 Lin ..... G06F 3/0416
2016/0358551 A1* 12/2016 Nagayama ..... G09G 3/20
2017/0061872 A1* 3/2017 Zhou ..... G09G 3/3291
2017/0061890 A1* 3/2017 Zhou ..... G09G 3/3275
2017/0092215 A1* 3/2017 Chang ..... G09G 3/006
2017/0115798 A1* 4/2017 Ho ..... G06F 3/0412
2017/0123529 A1* 5/2017 Ho ..... G06F 3/044
2017/0309644 A1* 10/2017 Yeh ..... H01L 27/124
2017/0322446 A1* 11/2017 Tae ..... G02F 1/133345
2017/0345372 A1* 11/2017 Xiao ..... G09G 3/3677
2018/0061350 A1* 3/2018 Sung ..... G09G 3/3696
2018/0219025 A1* 8/2018 Takahashi ..... G09G 3/3611
2018/0357946 A1* 12/2018 Ryu ..... G09G 3/2092
2019/0073939 A1* 3/2019 Hu ..... G09G 3/2092
2019/0164489 A1* 5/2019 Zhang ..... G09G 3/3258
2019/0189232 A1* 6/2019 Wang ..... G09G 3/20
2019/0228712 A1* 7/2019 Li ..... G09G 3/3266
2019/0235334 A1* 8/2019 Wu ..... G02F 1/136286
2019/0259345 A1* 8/2019 Hosoyachi ..... G09G 3/3677
2019/0259347 A1* 8/2019 Furuta ..... G09G 3/3677

* cited by examiner

GATE DRIVING CIRCUIT AND ITS DRIVING METHOD, ARRAY SUBSTRATE AND DISPLAY DEVICE

CROSS-REFERENCE TO RELATED APPLICATION

This application claims a priority to Chinese Patent Application No. 201810164196.6 filed on Feb. 27, 2018, the disclosure of which is incorporated in its entirety by reference herein.

TECHNICAL FIELD

The present disclosure relates to the field of display technology, in particular to a gate driving circuit and its driving method, an array substrate and a display device.

BACKGROUND

In order to realize a large-sized screen display, the display industry has continuously developed various special-shaped display screens, such as irregular-shaped screens having an L corner, an R corner, a U corner or a C corner. At the same time, in order to reduce cost, a Gate on Array (GOA) technology for driving an integrated circuit (IC) is usually used on a panel. For the driving of an irregular-shaped screen, a common approach in related art involves driving simultaneously on both sides, i.e., inputting a same signal simultaneously on left and right sides, to achieve normal display of the areas having the U corner or L corner. However, driving simultaneously on both sides requires a large area for designing the GOA circuit, which makes it difficult to meet the design requirements of a narrow frame.

SUMMARY

According to a first aspect, an embodiment of the present disclosure provides a gate driving circuit for driving an irregular-shaped display panel. The irregular-shaped display panel includes a regular-shaped display area and a first irregular-shaped display area. The regular-shaped display area includes one or more first scan lines and one or more second scan lines alternately arranged in a column direction, and the first irregular-shaped display area includes one or more third scan lines and one or more fourth scan lines alternately arranged in the column direction. The gate driving circuit includes a first driving module configured to drive the one or more first scan lines and a second driving module configured to drive the one or more second scan lines. The one or more third scan lines are driven by the first driving module or the second driving module, and the one or more fourth scan lines are driven by the first driving module or the second driving module.

According to one alternative embodiment of the present disclosure, the one or more first scan lines are one or more scan lines in one or more odd-numbered rows of the regular-shaped display area, and the one or more second scan lines are one or more scan lines in one or more even-numbered rows of the regular-shaped display area; and the one or more third scan lines are one or more scan lines in one or more odd-numbered rows of the first irregular-shaped display region, and the one or more fourth scan lines are one or more scan lines in one or more even-numbered rows of the first irregular-shaped display region.

According to one alternative embodiment of the present disclosure, the first driving module includes a GOA circuit configured to drive the one or more first scan lines and a third GOA circuit configured to drive the one or more third scan lines, and the second driving module includes a second GOA circuit configured to drive the one or more second scan lines and a fourth GOA circuit configured to drive the one or more fourth scan lines. The first GOA circuit and the third GOA circuit each include a plurality of GOA units cascaded with each other. A signal input terminal of a first level GOA unit of the third GOA circuit is connected to a signal output terminal of the last level GOA unit of the first GOA circuit, and a signal output terminal of the first level GOA unit of the third GOA circuit is connected to a reset terminal of the last level GOA unit of the first GOA circuit. The second GOA circuit and the fourth GOA circuit each include a plurality of GOA units cascaded with each other. A signal input terminal of a first level GOA unit of the fourth GOA circuit is connected to a signal output terminal of the last level GOA unit of the second GOA circuit, and a signal output terminal of the first level GOA unit of the fourth GOA circuit is connected to a reset terminal of the last level GOA unit of the second GOA circuit.

According to one alternative embodiment of the present disclosure, the first GOA circuit and the third GOA circuit are connected to a same CLK signal line, and the second GOA circuit and the fourth GOA circuit are connected to another same CLK signal line.

According to one alternative embodiment of the present disclosure, the first GOA circuit is sequentially connected to the third GOA circuit and the fourth GOA circuit.

According to one alternative embodiment of the present disclosure, the arranging alternately in the column direction includes arranging alternately every one row of the first scan line and every one row of the second scan line in the column direction, or alternately arranging every one row of the third scan line and every one row of the fourth scan line in the column direction.

According to one alternative embodiment of the present disclosure, the arranging alternately in the column direction includes arranging alternately every two rows of the first scan lines and every two rows of the second scan lines in the column direction, or arranging alternately every two rows of the third scan lines and every two rows of the fourth scan lines in the column direction.

According to one alternative embodiment of the present disclosure, the irregular-shaped display panel further includes a second irregular-shaped display area that includes one or more fifth scan lines and one or more sixth scan lines alternately arranged in the column direction. The one or more fifth scan lines are driven by the first driving module or the second driving module, and the one or more sixth scan lines are driven by the first driving module or the second driving module.

According to one alternative embodiment of the present disclosure, the one or more fifth scan lines are one or more scan lines in one or more odd-numbered rows of the second irregular-shaped display area, and the one or more sixth scan lines are one or more scan lines in one or more even-numbered rows of the second irregular-shaped display areas.

According to one alternative embodiment of the present disclosure, the first driving module includes a first GOA circuit configured to drive the one or more first scan lines, a third GOA circuit configured to drive the one or more third scan lines and a fifth GOA circuit configured to drive the one or more fifth scan lines; and the second driving module comprises a second GOA circuit configured to drive the one or more second scan lines, a fourth GOA circuit configured to drive the one or more fourth scan lines and a sixth GOA circuit configured to drive the one or more sixth scan lines. The first GOA circuit, the third GOA circuit and the fifth GOA circuit each include a plurality of GOA units cascaded with each other. A signal input terminal of a first level GOA unit of the third GOA circuit is connected to a signal output terminal of the last level GOA unit of the first GOA circuit; a signal output terminal of the first level GOA unit of the third GOA circuit is connected to a reset terminal of the last level GOA unit of the first GOA circuit; a signal input terminal of a first level GOA unit of the fifth GOA circuit is connected to a signal output terminal of the last level GOA unit of the third GOA circuit; and a signal output terminal of the first level GOA unit of the fifth GOA circuit is connected to a reset terminal of the last level GOA unit of the third GOA circuit. The second GOA circuit, the fourth GOA circuit and the sixth GOA circuit each include a plurality of GOA units cascaded with each other. A signal input terminal of a first level GOA unit of the sixth GOA circuit is connected to a signal output terminal of the last level GOA unit of the second GOA circuit; and a signal output terminal of the first level GOA unit of the sixth GOA circuit is connected to a reset terminal of the last level GOA unit of the second GOA circuit; a signal input terminal of a first level GOA unit of the fourth GOA circuit is connected to a signal output terminal of the last level GOA unit of the sixth GOA circuit; and a signal output terminal of the first level GOA unit of the fourth GOA circuit is connected to a reset terminal of the last level GOA unit of the sixth GOA circuit.

According to one alternative embodiment of the present disclosure, the first driving module includes a first GOA circuit configured to drive the one or more first scan lines, a third GOA circuit configured to drive the one or more third scan lines and a fourth GOA circuit configured to drive the one or more fourth scan lines; and the second driving module includes a second GOA circuit configured to drive the one or more second scan lines, a sixth GOA circuit configured to drive the one or more sixth scan lines and a fifth GOA circuit configured to drive the one or more fifth scan lines. The first GOA circuit, the third GOA circuit and the fourth GOA circuit each include a plurality of GOA units cascaded with each other. A signal input terminal of a first level GOA unit of the third GOA circuit is connected to a signal output terminal of the last level GOA unit of the first GOA circuit; a signal output terminal of the first level GOA unit of the third GOA circuit is connected to a reset terminal of the last level GOA unit of the first GOA circuit; a signal input terminal of a first level GOA unit of the fourth GOA circuit is connected to a signal output terminal of the last level GOA unit of the third GOA circuit; and a signal output terminal of the first level GOA unit of the fourth GOA circuit is connected to a reset terminal of the last level GOA unit of the third GOA circuit. The second GOA circuit, the fifth GOA circuit and the sixth GOA circuit each include a plurality of GOA units cascaded with each other. A signal input terminal of a first level GOA unit of the sixth GOA circuit is connected to a signal output terminal of the last level GOA unit of the second GOA circuit; a signal output terminal of the first level GOA unit of the sixth GOA circuit is connected to a reset terminal of the last level GOA unit of the second GOA circuit. a signal input terminal of a first level GOA unit of the fifth GOA circuit is connected to a signal output terminal of the last level GOA unit of the sixth GOA circuit; and a signal output terminal of the first level GOA unit of the fifth GOA circuit is connected to a reset terminal of the last level GOA unit of the sixth GOA circuit.

According to one alternative embodiment of the present disclosure, the first GOA circuit, the third GOA circuit, and the fourth GOA circuit are connected to a same CLK signal line; and the second GOA circuit, the fifth GOA circuit, and the sixth GOA circuit are connected to another same CLK signal line.

According to one alternative embodiment of the present disclosure, the arranging alternately in the column direction includes arranging alternately every one row of the fifth scan line and every one row of the six scan line in the column direction.

According to one alternative embodiment of the present disclosure, the arranging alternately in the column direction includes arranging alternately every two rows of the fifth scan lines and every two rows of the sixth scan lines in the column direction.

According to a second aspect, an embodiment of the present disclosure provides an array substrate that includes a gate driving circuit for driving an irregular-shaped display panel. The irregular-shaped display panel includes a regular-shaped display area and a first irregular-shaped display area. The regular-shaped display area includes one or more first scan lines and one or more second scan lines alternately arranged in a column direction. The first irregular-shaped display area includes one or more third scan lines and one or more fourth scan lines alternately arranged in the column direction. The gate driving circuit includes a first driving module configured to drive the one or more first scan lines and a second driving module configured to drive the one or more second scan lines. The one or more third scan lines are driven by the first driving module or the second driving module, and the one or more fourth scan lines are driven by the first driving module or the second driving module.

According to one alternative embodiment of the present disclosure, the one or more first scan lines are one or more scan lines in one or more odd-numbered rows of the regular-shaped display area, and the one or more second scan lines one or more scan lines in one or more even-numbered rows of the regular-shaped display area. The one or more third scan lines are one or more scan lines in one or more odd-numbered rows of the first irregular-shaped display region, and the one or more fourth scan lines are one or more scan lines in one or more even-numbered rows of the first irregular-shaped display region.

According to one alternative embodiment of the present disclosure, the irregular-shaped display panel further includes a second irregular-shaped display area that includes one or more fifth scan lines and one or more sixth scan lines alternately arranged in the column direction. The one or more fifth scan lines are driven by the first driving module or the second driving module, and the one or more sixth scan lines are driven by the first driving module or the second driving module.

According to a third aspect, an embodiment of the present disclosure provides a display device that includes the array substrate as described in the second aspect.

According to a fourth aspect, an embodiment of the present disclosure provides a gate driving method for a gate driving circuit configured to drive an irregular-shaped display panel. The irregular-shaped display panel includes a regular-shaped display area and a first irregular-shaped display area. The regular-shaped display area includes one or more first scan lines and one or more second scan lines alternately arranged in a column direction, and the first irregular-shaped display area includes one or more third scan lines and one or more fourth scan lines alternately arranged in the column direction. The gate driving circuit includes a first driving module configured to drive the one or more first scan lines and a second driving module configured to drive the one or more second scan lines. The one or more third scan lines are driven by the first driving module or the second driving module, and the one or more fourth scan lines are driven by the first driving module or the second driving module. The method includes: inputting a driving signal to each of the first driving module and the second driving module; driving the one or more first scan lines and the one or more second scan lines of the regular-shaped display area to scan; and driving the one or more third scan lines and the one or more fourth scan lines of the first irregular-shaped display area to scan.

According to one alternative embodiment of the present disclosure, when the irregular-shaped display panel further includes a second irregular-shaped display area that includes one or more fifth scan lines and one or more sixth scan lines alternately arranged in the column direction. The method further includes: driving the one or more fifth scan lines and the one or more sixth scan lines of the second irregular-shaped display area to scan.

BRIEF DESCRIPTION OF THE DRAWINGS

To illustrate the technical solutions of the embodiments of the present disclosure more clearly, the accompanying drawings necessary for describing the embodiments of the present disclosure will be briefly described hereinafter. Apparently, these drawings merely show some embodiments of the present disclosure, and based on these drawings, other drawings can be obtained by a person having ordinary skills in the art without exercising any inventive skills.

LIST OF REFERENCE SIGNS

1—regular-shaped display area; 2—first irregular-shaped display area; 3—second irregular-shaped display area; 11—first scan line; 12—second scan line; 13—third scan line; 14—fourth scan line; 15—first driving module; 16—second driving module; STV1—first frame start signal terminal; STV2—second frame start signal terminal; 21—first GOA circuit; 22—second GOA circuit; 23—third GOA circuit; 24—fourth GOA circuit; 31—fifth scan line; 32—sixth scan line; 33—fifth GOA circuit; 34—sixth GOA circuit

DETAILED DESCRIPTION

To make the above objects, features and advantages of the present disclosure more readily appreciated, the present disclosure will be further described hereinafter in detail in conjunction with the drawings and specific embodiments.

Figure 1:
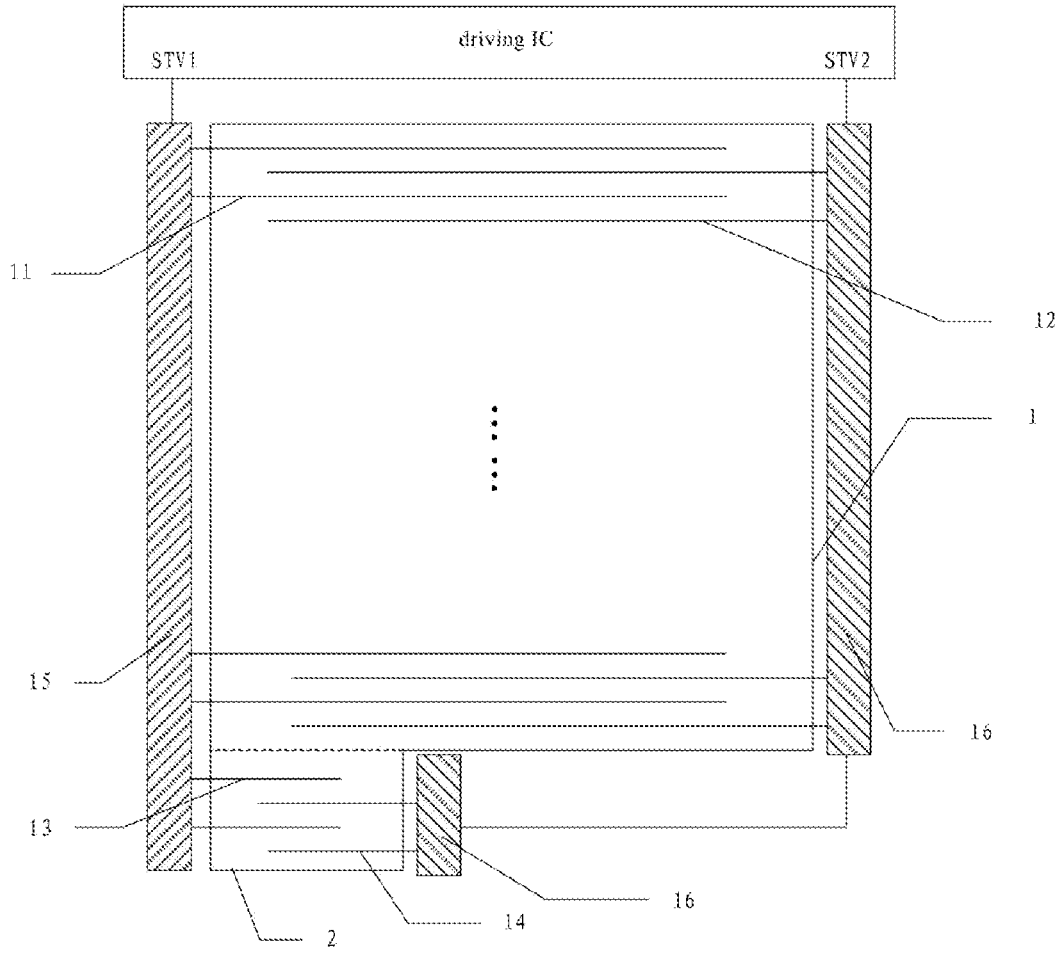
FIG. 1 is a structural schematic view showing a gate driving circuit provided in an embodiment of the present disclosure.

Reference is made to FIG. 1 that shows a structural schematic view showing a gate driving circuit provided in an embodiment of the present disclosure. The gate driving circuit shown in FIG. 1 is used for driving an irregular-shaped display panel. The irregular-shaped display panel includes a regular-shaped display area 1 and a first irregular-shaped display area 2. The regular-shaped display area 1 includes one or more scan lines 11 and one or more scan lines 12 alternately arranged in a column direction. The first irregular-shaped display area 2 includes one or more third scan lines 13 and one or more fourth scan lines 14 alternately arranged in the column direction. The gate driving circuit includes a first driving module 15 for driving the one or more first scan lines 11 and a second driving module 16 for driving the one or more second scan lines 12. The one or more third scan lines 13 are driven by the first driving module 15 or the second driving module 16, and the one or more fourth scan lines 14 are driven by the first driving module 15 or the second driving module 16. FIG. 1 is given by way of an example, in which the third scan line 13 is driven by the first driving module 15, and the fourth scan line 14 is driven by the second driving module 16.

Specifically, the first driving module 15 and the second driving module 16 are connected to a first frame start signal terminal STV1 and a second frame start signal terminal STV2, respectively. In other words, time points at which the first driving module 15 and the second driving module 16 start to output scan signals in each frame of picture can be controlled separately, that is, in a manner of driving non-simultaneously on both sides, which is different from the simultaneous driving in the related art in which the same signal is inputted simultaneously on the left and right sides. Moreover, the non-simultaneous driving on both sides requires only a small area for arranging a GOA circuit, thereby making it possible to meet the requirement of achieving the narrow frame design.

In this embodiment, arranging alternately the first and second scan lines in the column direction may refer to arranging alternately every one row of the first scan line and every one row of the second scan line in the column direction, or arranging alternately every two rows of the first scan lines and every two rows of the second scan lines in the column direction. For the arranging alternately every one row of the first scan line and every one row of the second scan line in the column direction, it refer to a case that the one or more first scan lines are arranged in either one or more odd-numbered or even-numbered rows, and the one or more second scan lines are correspondingly arranged in either one or more even-numbered or odd-numbered rows in the column direction. This also applies to the one or more third scan lines 13 and the one or more fourth scan lines 14. For example, the one or more first scan lines 11 are one or more scan lines in one or more odd-numbered rows of the regular-shaped display area 1, and the one or more second scan lines 12 are one or more scan lines in one or more even-numbered rows of the regular-shaped display area 1; and the one or more third scan lines 13 are one or more scan lines in one or more odd-numbered rows of the first irregular-shaped display area 2, and the one or more fourth scan lines 14 are one or more scan lines in one or more even-numbered rows of the first irregular-shaped display area 2. Alternatively, the one or more first scan lines 11 are one or more scan lines in one or more even-numbered rows of the regular-shaped display area 1, and the one or more second scan lines 12 are one or more scan lines in one or more odd-numbered rows of the regular-shaped display area 1; and the one or more third scan lines 13 are one or more scan lines in one or more even-numbered rows of the first irregular-shaped display area 2, and the one or more fourth scan lines 14 are one or more scan lines in one or more odd-numbered rows of the first irregular-shaped display area 2.

The gate driving circuit provided in this embodiment can allow for the manner of non-simultaneous driving on both sides of the regular-shaped display area to be applied to the driving of the first irregular-shaped display area, thereby achieving the full display of the irregular-shaped screen. Moreover, such a manner of driving non-simultaneously on both sides can meet the requirement of achieving the narrow frame design.

Below, two implementations of the irregular-shaped display panel, i.e., including one irregular-shaped display area and including two irregular-shaped display areas, are described in detail by way of examples, in which the one or more first scan lines 11 are one or more scan lines in one or more odd-numbered rows of the regular-shaped display area 1, and the one or more second lines 12 are one or more scan lines in one or more even-numbered rows of the regular-shaped display area 1, the one or more third scan lines 13 are one or more scan lines in one or more odd-numbered rows of the first irregular-shaped display area 2, and the one or more fourth scan lines 14 are one or more scan lines in one or more even-numbered rows of the first irregular-shaped display area 2.

Figure 2:
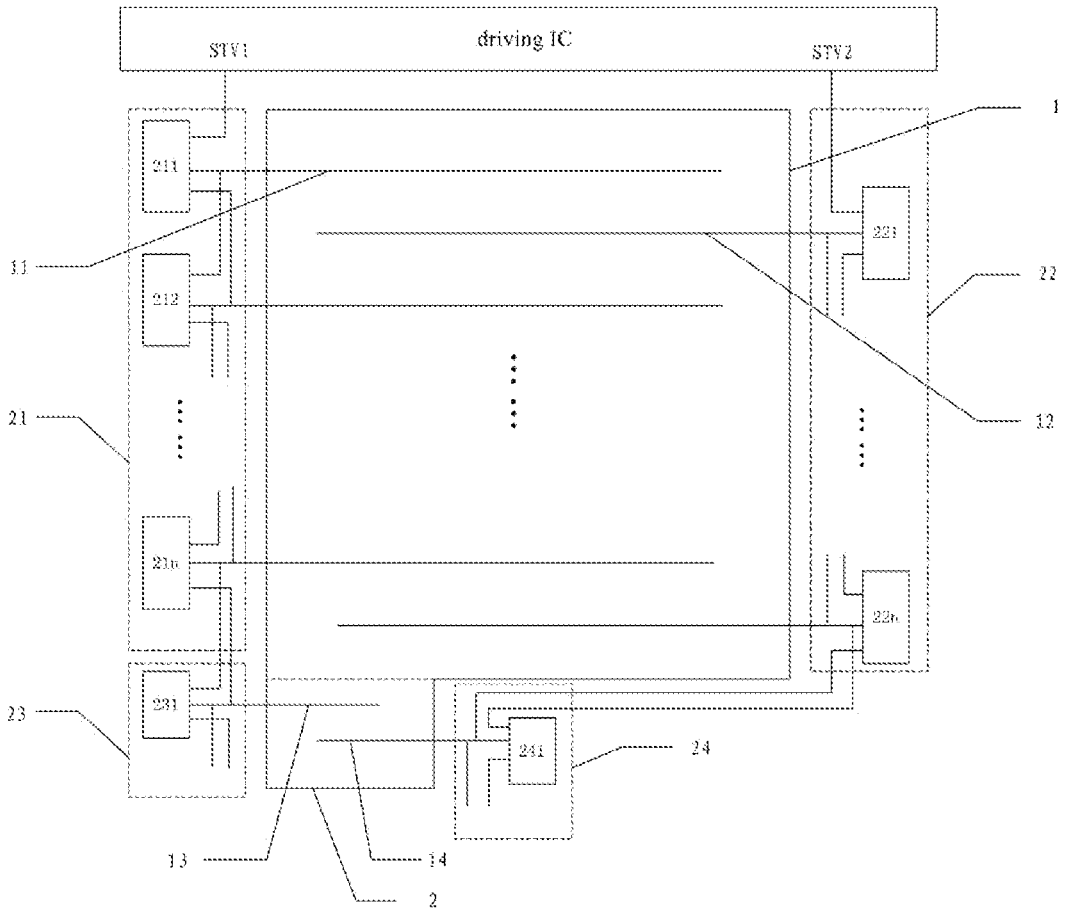
FIG. 2 is a structural schematic view showing a gate driving circuit with an irregular-shaped display panel including only a first irregular-shaped display area, provided in another embodiment of the present disclosure.

Reference is made to FIG. 2 that is a structural schematic view showing a gate driving circuit with an irregular-shaped display panel including only a first regular-shaped display area. The first driving module of the gate driving circuit may include a first GOA circuit 21 and a third GOA circuit 23, and the second driving module of the gate driving circuit may include a second GOA circuit 22 and a fourth GOA circuit 24. The first GOA circuit 21 is configured to drive the one or more first scan lines 11, the second GOA circuit 22 is configured to drive the one or more second scan lines 12, the third GOA circuit 23 is configured to drive the one or more third scan lines 13, and the fourth GOA circuit 24 is configured to drive the one or more fourth scan lines 14. The first GOA circuit 21 and the third GOA circuit 23 each include a plurality of GOA units cascaded with each other. A signal input terminal of a first level GOA unit 231 of the third GOA circuit 23 is connected to a signal output terminal of the last level GOA unit 21*n* of the first GOA circuit 21; and a signal output terminal of the first level GOA 231 unit of the third GOA circuit 23 is connected to a reset terminal of the last level GOA unit 21*n* of the first GOA circuit 21.

The second GOA circuit 22 and the fourth GOA circuit 24 each include a plurality of GOA units cascaded with each other. A signal input terminal of a first level GOA unit 241 of the fourth GOA circuit 24 is connected to a signal output terminal of the last level GOA unit 22*n* of the second GOA circuit 22; and a signal output terminal of the first level GOA unit 241 of the fourth GOA circuit 24 is connected to a reset terminal of the last level GOA unit 22*n* of the second GOA circuit 22.

If $\alpha$ third scan lines and a fourth scan lines are formed in the first irregular-shaped display area, there will be a GOA units that are correspondingly provided in the third GOA circuit, and another $\alpha$ GOA units that are correspondingly provided in the fourth GOA circuit. In this case, a control integrated circuit (IC) will be required to add $2*\alpha$ scan driving signals in addition to outputting scan driving signals of the regular-shaped display area during a display period of one frame of picture. A Data IC correspondingly and repeatedly outputs data signals based on scan lines which are turned on.

In this embodiment, the connection relationships between the GOA circuits, such as between the first GOA circuit 21 and the third GOA circuit 23, and between the second GOA circuit 22 and the fourth GOA circuit 24, are not limited to those of the GOA units as described above. All the relationships that can realize the cascade connections between the GOA units should fall within the protection scope of the present application.

In addition, the first GOA circuit 21 and the third GOA circuit 23 may be connected to a same CLK signal line, such as CLK1, CLK2, CLK3, CLK4, OUTPUT or the like. The second GOA circuit 22 and the fourth GOA circuit 24 may be connected to another same CLK signal line, such as CLK1, CLK2, CLK3, CLK4, OUTPUT or the like.

In a practical application, the first GOA circuit 21 and the second GOA circuit 22 may be made in the regular-shaped display area 1, and the third GOA circuit 23 and the fourth GOA circuit 24 may be made in the first irregular-shaped display area 2. The first GOA circuit 21 and the third GOA circuit 23 may be provided on a first side (left side in FIG. 2) of the irregular-shaped display panel, while the second GOA circuit 22 and the fourth GOA circuit 24 may be provided on the other side (right side in FIG. 2) opposite to the first side, and their specific positions and connection relationships may be set with reference to FIG. 2.

It should be noted that, FIG. 2 is given by way of an example, in which the first GOA circuit 21 is connected to the third GOA circuit 23, and the second GOA circuit 22 is connected to the fourth GOA circuit 24. In a practical application, the first GOA circuit 21 may be connected to the fourth GOA circuit 24, and the second GOA circuit 22 may be connected to the third GOA circuit 23. Alternatively, it may be even possible that the first GOA circuit 21 is sequentially connected to the third GOA circuit 23 and the fourth GOA circuit 24. Any connection mode in which the normal display can be realized when the non-simultaneous driving circuit for the regular-shaped display area is used to drive the irregular-shaped display area should fall within the protection scope of the present application.

Figure 3:
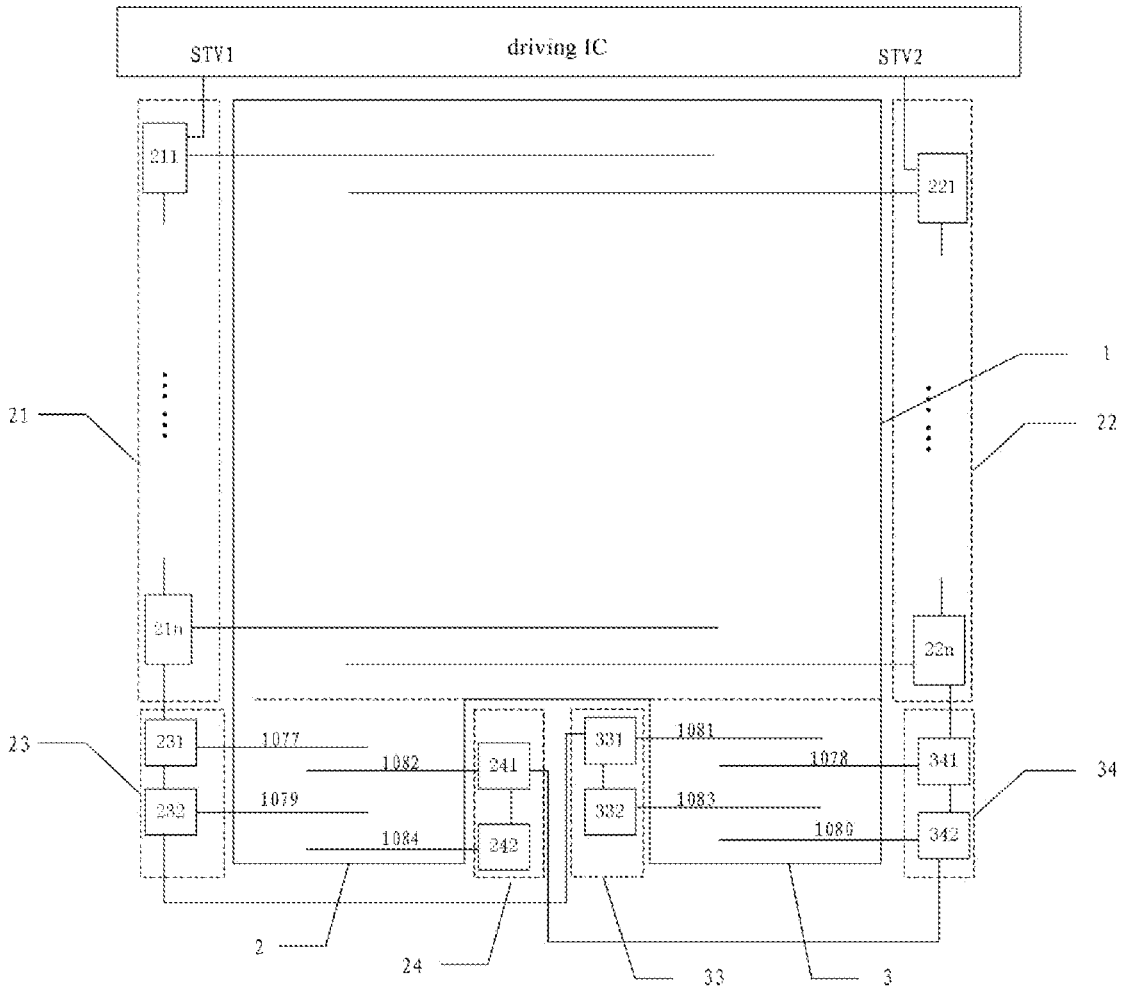
FIG. 3 is a structural schematic view showing a first gate driving circuit with an irregular-shaped display panel including a first irregular-shaped display area and a second irregular-shaped display area, provided in a further embodiment of the present disclosure.

Reference is made to FIG. 3 that shows a structural schematic view of a gate driving circuit with an irregular-shaped display panel including a first irregular-shaped display area 2 and a second irregular-shaped display area 3. The second irregular-shaped display area 3 includes one or more fifth scan lines 31 and one or more sixth scan lines 32 alternately arranged in the column direction. The one or more fifth scan lines 31 are driven by the first driving module or the second driving module, and the one or more sixth scan lines 32 are driven by the first driving module or the second driving module.

Arranging alternately the one or more fifth scan lines and the sixth scan lines in the column direction includes arranging alternately every one row of the fifth scan line and every one row of the sixth scan line in the column direction, or arranging alternately every two rows of the fifth scan lines and every two rows of the sixth scan lines in the column direction. This embodiment is described by way of the example in the former case. That is, the one or more fifth scan lines 31 are one or more scan lines in one or more odd-numbered rows of the second irregular-shaped display area 3, and the one or more sixth scan lines 32 are one or more scan lines in one or more even-numbered rows of the second irregular-shaped display area 3.

In an implementation of this embodiment, as shown in FIG. 3, the first driving module may include a first GOA circuit 21, a third GOA circuit 23 and a fifth GOA circuit 33, and the second driving module may include a second GOA circuit 22, a fourth GOA circuit 24 and a sixth GOA circuit 34. The first GOA circuit 21 is configured to drive the one or more first scan lines 11, the second GOA circuit 22 is configured to drive the one or more second scan lines 12, the third GOA circuit 23 is configured to drive the one or more third scan lines 13, the fourth GOA circuit 24 is configured to drive the one or more fourth scan lines 14, the fifth GOA circuit 33 is configured to drive the one or more fifth scan lines 31, and the sixth GOA circuit 34 is configured to drive the one or more sixth scan lines 32.

The first GOA circuit 21, the third GOA circuit 23 and the fifth GOA circuit 33 each include a plurality of GOA units cascaded with each other. A signal input terminal of a first level GOA unit 231 of the third GOA circuit 23 is connected to a signal output terminal of the last level GOA unit 21*n* of the first GOA circuit 21; a signal output terminal of the first level GOA unit 231 of the third GOA circuit 23 is connected to a reset terminal of the last level GOA unit 21*n* of the first GOA circuit 21; a signal input terminal of a first level GOA unit 331 of the fifth GOA circuit 33 is connected to a signal output terminal of the last level GOA unit 23*n* of the third GOA circuit 23; and a signal output terminal of the first level GOA unit 331 of the fifth GOA circuit 33 is connected to a reset terminal of the last level GOA unit 23*n* of the third GOA circuit 23.

The second GOA circuit 22, the fourth GOA circuit 24 and the sixth GOA circuit 34 each include a plurality of GOA units cascaded with each other. A signal input terminal of a first level GOA unit 341 of the sixth GOA circuit 34 is connected to a signal output terminal of the last level GOA unit 22*n* of the second GOA circuit 22; and a signal output terminal of the first level GOA unit 341 of the sixth GOA circuit 34 is connected to a reset terminal of the last level GOA unit 22*n* of the second GOA circuit 22; a signal input terminal of a first level GOA unit 241 of the fourth GOA circuit 24 is connected to a signal output terminal of the last level GOA unit 34*n* of the sixth GOA circuit 34; and a signal output terminal of the first level GOA unit 241 of the fourth GOA circuit 24 is connected to a reset terminal of the last level GOA unit 34*n* of the sixth GOA circuit 34.

In this embodiment, the connection relationships between the GOA circuits, such as between the first GOA circuit 21, the third GOA circuit 23 and the fifth GOA circuit 33, and between the second GOA circuit 22, the fourth GOA circuit 24 and the sixth GOA circuit 34, are not limited to those described herein. All the relationships that can realize the cascade connections between the GOA units should fall within the protection scope of the present application. It should be noted that FIG. 3 only shows a schematic view of the connections between the GOA units.

In addition, the first GOA circuit 21, the third GOA circuit 23 and the fifth GOA circuit 33 may be connected to a same CLK signal line, such as CLK1, CLK2, CLK3, CLK4, OUTPUT or the like. The second GOA circuit 22, the fourth GOA circuit 24 and the sixth GOA circuit 34 may be connected to another same CLK signal line, such as CLK1, CLK2, CLK3, CLK4, OUTPUT or the like.

The signal input terminal of the first level GOA unit 211 of the first GOA circuit 21 may be connected to a first frame start signal input terminal STV1. The signal input terminal of the first level GOA unit 221 of the second GOA circuit 22 may be connected to a second frame start signal input terminal STV2.

In a practical application, the first GOA circuit 21 and the second GOA circuit 22 may be made in the regular-shaped display area 1, the third GOA circuit 23 and the fourth GOA circuit 24 may be made in the first irregular-shaped display area 2, and the fifth GOA circuit 33 and the sixth GOA circuit 34 may be made in the second irregular-shaped display area 3. The first GOA circuit 21, the third GOA circuit 23 and the fifth GOA circuit 33 may be provided close to a first side (left side in FIG. 3) of the irregular-shaped display panel, and the second GOA circuit 22, the fourth GOA circuit 24 and the sixth GOA circuit 34 may be provided close to a second side (right side in FIG. 3). FIG. 3 is given by way of an example, in which the first irregular-shaped display area 2 is close to the first side of the irregular-shaped display panel and the second irregular-shaped display area 3 is close to the second side of the irregular-shaped display panel.

In an actual process of driving the display device to display images, after the control IC outputs a frame start signal, a corresponding data signal is generated by the Data IC, and thereafter the display is realized. That is, when each row of the scan lines is turned on, a corresponding data signal will be inputted by the Data IC to realize the update of the displayed images.

For example, the irregular-shaped display panel includes a total of 1080 rows of gate scan lines, of which row 1 to row 1076 are located in the regular-shaped display area, with the first scan lines in odd-numbered rows and driven by the first GOA circuit 21 and the second scan lines in even-numbered rows and driven by the second GOA circuit 22. Row 1077 to Row 1080 are located in two U-shaped corner areas, which correspond to the first irregular-shaped display area 2 (the left U-shaped corner in FIG. 3) and the second irregular-shaped display area 3 (the right U-shaped corner in FIG. 3), respectively. Scan lines in rows 1077 and 1079 of the left U-shaped corner are the third scan lines and driven by the third GOA circuit 23. Scan lines in rows 1078 and 1080 of the right U-shaped corner are the sixth scan lines and driven by the sixth GOA circuit 34. The remaining two scan lines of the left U-shaped corner are numbered 1082 and 1084, are the fourth scan lines and driven by the fourth GOA circuit 24. The remaining two scan lines of the right U-shaped corner are numbered 1081 and 1083, are the fifth scan lines and driven by the fifth GOA circuit 33. In a practical driving process, the order in which the gate scan lines are turned on and corresponding input data signals are shown in Table 1 below. The control IC outputs a total of 1084 GOA signals, including clk signals. The Data IC repeatedly outputs data signals based on the added gate signals. The Data signals in Table 1 are represented by row numbers of the corresponding gate scan lines.

TABLE 1 a driving process of the gate driving circuit shown in FIG. 3

| row number of the corresponding gate scan line | Data signal |
|---|---|
| 1 | 1 |
| 2 | 2 |
| . . . | . . . |
| 1077 | 1077 |
| 1078 | 1078 |
| 1079 | 1079 |
| 1080 | 1080 |
| 1081 | replication of 1077 |
| 1082 | replication of 1078 |
| 1083 | replication of 1079 |
| 1084 | replication of 1080 |

Figure 4:
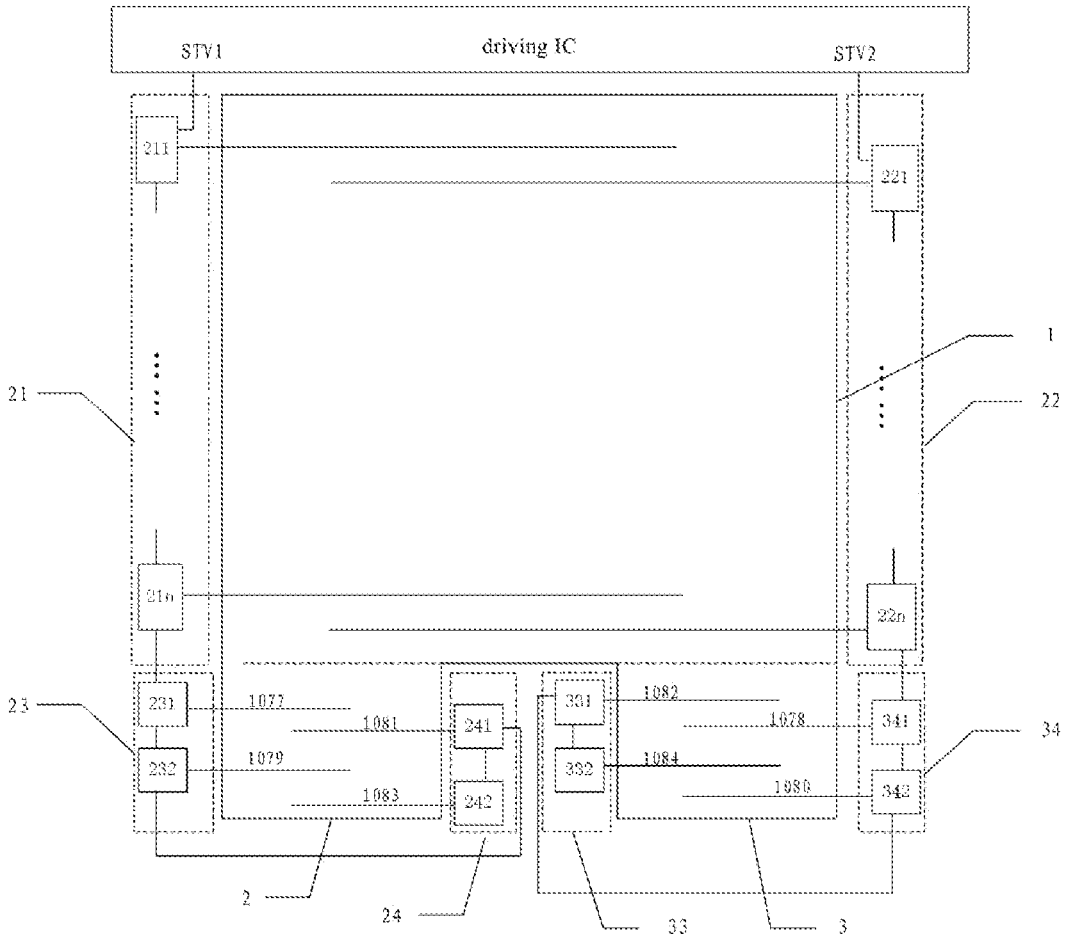
FIG. 4 is a structural schematic view showing a second gate driving circuit with an irregular-shaped display panel including a first irregular-shaped display area and a second irregular-shaped display area, provided in another embodiment of the present disclosure.

In another implementation of this embodiment, as shown in FIG. 4, the first driving module may include a first GOA circuit 21, a third GOA circuit 23 and a fourth GOA circuit 24, and the second driving module may include a second GOA circuit 22, a sixth GOA circuit 34 and a fifth GOA circuit 33. The first GOA circuit 21 is configured to drive the one or more first scan lines 11, the second GOA circuit 22 is configured to drive the one or more second scan lines 12, the third GOA circuit 23 is configured to drive the one or more third scan lines 13, the fourth GOA circuit 24 is configured to drive the one or more fourth scan lines 14, the fifth GOA circuit 33 is configured to drive the one or more fifth scan lines 31, and the sixth GOA circuit 34 is configured to drive the one or more sixth scan lines 32.

The first GOA circuit 21, the third GOA circuit 23 and the fourth GOA circuit 24 each include a plurality of GOA units cascaded with each other. A signal input terminal of a first level GOA unit 231 of the third GOA circuit 23 is connected to a signal output terminal of the last level GOA unit 21*n* of the first GOA circuit 21; a signal output terminal of the first level GOA unit 231 of the third GOA circuit 23 is connected to a reset terminal of the last level GOA unit 21*n* of the first GOA circuit 21; a signal input terminal of a first level GOA unit 241 of the fourth GOA circuit 24 is connected to a signal output terminal of the last level GOA unit 23*n* of the third GOA circuit 23; and a signal output terminal of the first level GOA unit 241 of the fourth GOA circuit 24 is connected to a reset terminal of the last level GOA unit 23*n* of the third GOA circuit 23.

The second GOA circuit 22, the fifth GOA circuit 33 and the sixth GOA circuit 34 each include a plurality of GOA units cascaded with each other. A signal input terminal of a first level GOA unit 341 of the sixth GOA circuit 34 is connected to a signal output terminal of the last level GOA unit 22*n* of the second GOA circuit 22; a signal output terminal of the first level GOA unit 341 of the sixth GOA circuit 34 is connected to a reset terminal of the last level GOA unit 22*n* of the second GOA circuit 22; a signal input terminal of a first level GOA unit 331 of the fifth GOA circuit 33 is connected to a signal output terminal of the last level GOA unit 34*n* of the sixth GOA circuit 34; and a signal output terminal of the first level GOA unit 331 of the fifth GOA circuit 33 is connected to a reset terminal of the last level GOA unit 34*n* of the sixth GOA circuit 34.

In this embodiment, the connection relationships between the GOA circuits are not limited to those described herein, and all the relationships that can realize the cascade connections between the GOA units should fall within the protection scope of the present application. It should be noted that FIG. 4 only shows a schematic view of the connections between the GOA units.

In addition, the first GOA circuit 21, the third GOA circuit 23 and the fourth GOA circuit 24 may be connected to a same CLK signal line, such as CLK1, CLK2, CLK3, CLK4, OUTPUT or the like. The second GOA circuit 22, the fifth GOA circuit 33 and the sixth GOA circuit 34 may be connected to another same CLK signal line, such as CLK1, CLK2, CLK3, CLK4, OUTPUT or the like.

The signal input terminal of the first level GOA unit 211 of the first GOA circuit 21 may be connected to a first frame start signal input terminal STV1. The signal input terminal of the first level GOA unit 221 of the second GOA circuit 22 may be connected to a second frame start signal input terminal STV2.

In a practical application, the first GOA circuit 21 and the second GOA circuit 22 may be made in the regular-shaped display area 1, the third GOA circuit 23 and the fourth GOA circuit 24 may be made in the first irregular-shaped display area 2, and the fifth GOA circuit 33 and the sixth GOA circuit 34 may be made in the second irregular-shaped display area 3. The first GOA circuit 21, the third GOA circuit 23 and the fifth GOA circuit 33 may be provided close to a first side (left side in FIG. 4) of the irregular-shaped display panel, and the second GOA circuit 22, the fourth GOA circuit 24 and the sixth GOA circuit 34 may be provided close to a second side (right side in FIG. 4). FIG. 4 is given by way of example, in which the first irregular-shaped display area 2 is close to the first side of the irregular-shaped display panel and the second irregular-shaped display area 3 is close to the second side of the irregular-shaped display panel.

For example, the irregular-shaped display panel includes a total of 1080 rows of gate scan lines, of which row 1 to row 1076 are located in the regular-shaped display area 1, with the first scan lines in odd-numbered rows and driven by the first GOA circuit 21 and the second scan lines in even-numbered rows and driven by the second GOA circuit 22. Row 1077 to Row 1080 are located in two U-shaped corner areas, which correspond to the first irregular-shaped display area 2 (the left U-shaped corner in FIG. 4) and the second irregular-shaped display area 3 (the right U-shaped corner in FIG. 4), respectively. Scan lines in rows 1077 and 1079 of the left U-shaped corner are the third scan lines and driven by the third GOA circuit 23. Scan lines in rows 1078 and 1080 of the right U-shaped corner are the sixth scan lines and driven by the sixth GOA circuit 34. The remaining two scan lines of the left U-shaped corner are numbered 1081 and 1083, are the fourth scan lines and driven by the fourth GOA circuit 24. The remaining two scan lines of the right U-shaped corner are numbered 1082 and 1084, are the fifth scan lines and driven by the fifth GOA circuit 33. In a practical driving process, the order in which the gate scan lines are turned on and corresponding input data signals are shown in Table 2 below. The control IC outputs a total of 1084 GOA signals, including clk signals. The Data IC repeatedly outputs data signals based on the added gate signals. The Data signals in Table 2 are represented by row numbers of the corresponding gate scan lines.

TABLE 2

| a driving process of the gate driving circuit shown in FIG. 4. | |
|---|---|
| row number of the corresponding gate scan line | Data signal |
| 1 | 1 |
| 2 | 2 |
| . . . | . . . |
| 1077 | 1077 |
| 1078 | 1078 |
| 1079 | 1079 |
| 1080 | 1080 |
| 1081 | replication of 1078 |
| 1082 | replication of 1077 |
| 1083 | replication of 1080 |
| 1084 | replication of 1079 |

Figure 5:
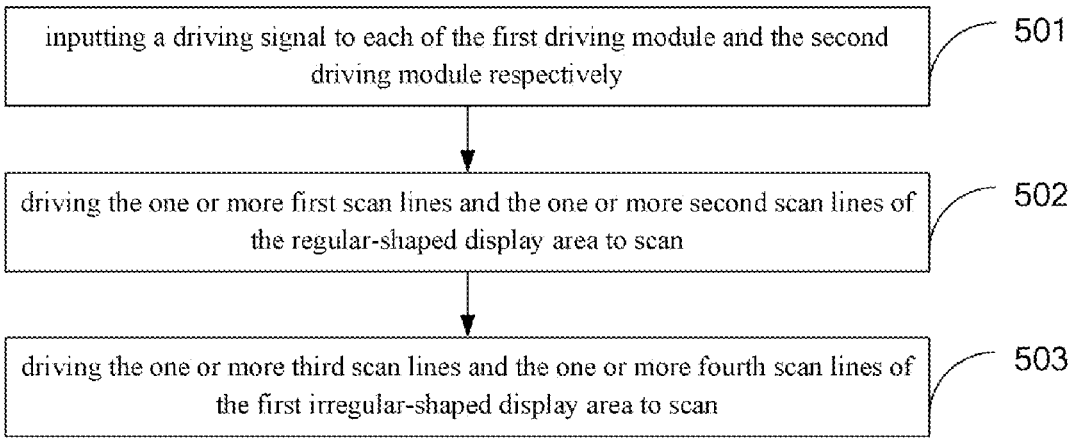
FIG. 5 is a flow chart showing steps of a gate driving method provided in an embodiment of the present disclosure.

In another embodiment of the present disclosure, as shown in FIG. 5 which shows a flow chart of steps of a gate driving method for the gate driving circuit as described above, the method may include:

step 501: inputting a driving signal to each of the first driving module and the second driving module;

step 502: driving the one or more first scan lines and the one or more second scan lines of the regular-shaped display area to scan; and step 503: driving the one or more third scan lines and the one or more fourth scan lines of the first irregular-shaped display area to scan.

Specifically, the driving signals may be input to the first driving module and the second driving module by the first frame start signal terminal STV1 and the second frame start signal terminal STV2, respectively. In addition, the one or more first scan lines may be one or more scan lines in one or more odd-numbered rows of the regular-shaped display area, and the one or more second scan lines may be one or more scan lines in one or more even-numbered rows of the regular-shaped display area, and the one or more third scan lines may be one or more scan lines in one or more odd-numbered rows of the first irregular-shaped display region, and the one or more fourth scan lines may be one or more scan lines in one or more even-numbered rows of the first irregular-shaped display region.

Figure 6:
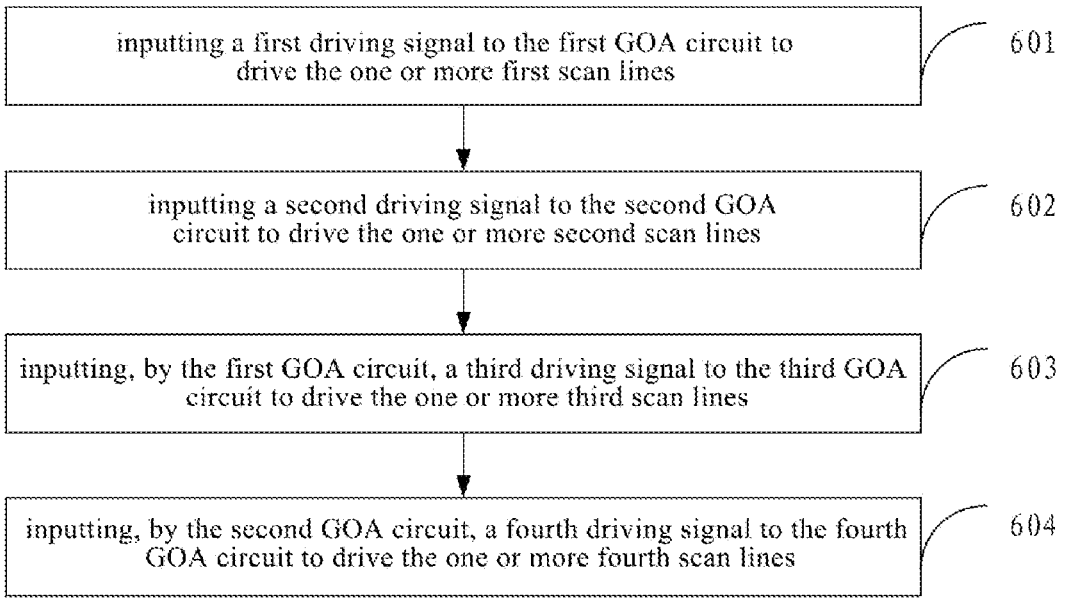
FIG. 6 is a flow chart showing steps of a gate driving method in which an irregular-shaped display panel includes only a first irregular-shaped display area, provided in an embodiment of the present disclosure.

When the first driving module includes a first GOA circuit and a third GOA circuit and the second driving module includes a second GOA circuit and a fourth GOA circuit, and when the gate driving circuit is one as shown in FIG. 2, you may refer to FIG. 6 for a flow chart of steps of a corresponding gate driving method. This method may include:

Step 601: inputting a first driving signal to the first GOA circuit to drive the one or more first scan lines;

Step 602: inputting a second driving signal to the second GOA circuit to drive the one or more second scan lines;

Step 603: inputting, by the first GOA circuit, a third driving signal to the third GOA circuit to drive the one or more third scan lines; and Step 604: inputting, by the second GOA circuit, a fourth driving signal to the fourth GOA circuit to drive the one or more fourth scan lines.

Figure 7:
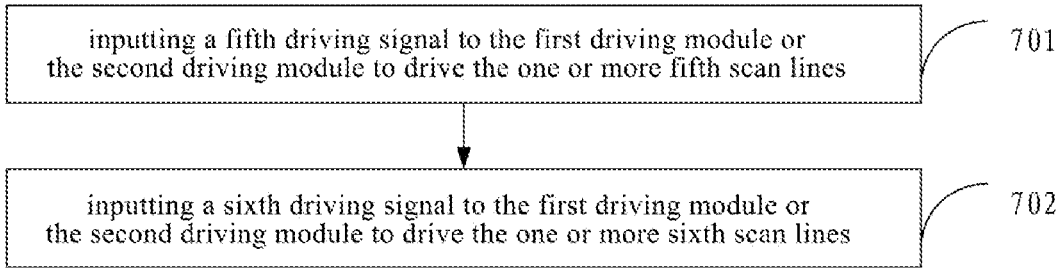
FIG. 7 is a flow chart showing steps of a gate driving method of a second irregular-shaped display area provided in an embodiment of the present disclosure.

When the irregular-shaped display panel further includes a second irregular-shaped display area that includes one or more fifth scan lines and one or more sixth scan lines alternately arranged in the column direction, the gate driving method may further include the following steps as shown in FIG. 7:

step 701: inputting a fifth driving signal to the first driving module or the second driving module to drive the one or more fifth scan lines; and step 702: inputting a sixth driving signal to the first driving module or the second driving module to drive the one or more sixth scan lines.

The one or more fifth scan lines may be one or more scan lines in one or more odd-numbered rows of the second irregular-shaped display area, and the one or more sixth scan lines may be one or more scan lines in one or more even-numbered rows of the second irregular-shaped display area.

Figure 8:
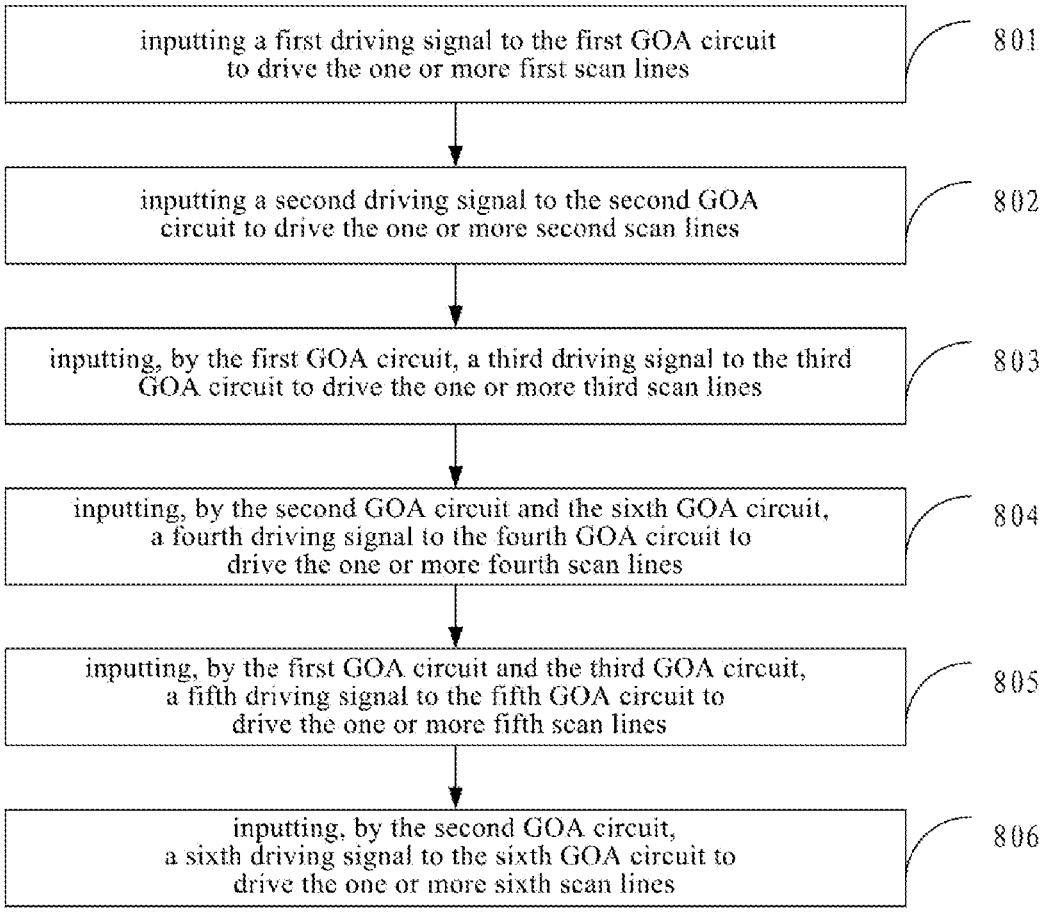
FIG. 8 is a flow chart showing steps of a first gate driving method in which an irregular-shaped display panel includes a first irregular-shaped display area and a second irregular-shaped display area, provided in another embodiment of the present disclosure.

When the first driving module includes a first GOA circuit, a third GOA circuit and a fifth GOA circuit, and the second driving module includes a second GOA circuit, a fourth GOA circuit and a sixth GOA circuit, and the gate driving circuit is one as shown in FIG. 3, a corresponding driving method may include the following steps as shown in FIG. 8:

step 801: inputting a first driving signal to the first GOA circuit to drive the one or more first scan lines;

step 802: inputting a second driving signal to the second GOA circuit to drive the one or more second scan lines;

step 803: inputting, by the first GOA circuit, a third driving signal to the third GOA circuit to drive the one or more third scan lines;

step 804: inputting, by the second GOA circuit and the sixth GOA circuit, a fourth driving signal to the fourth GOA circuit to drive the one or more fourth scan lines;

step 805: inputting, by the first GOA circuit and the third GOA circuit, a fifth driving signal to the fifth GOA circuit to drive the one or more fifth scan lines; and step 806: inputting, by the second GOA circuit, a sixth driving signal to the sixth GOA circuit to drive the one or more sixth scan lines.

Figure 9:
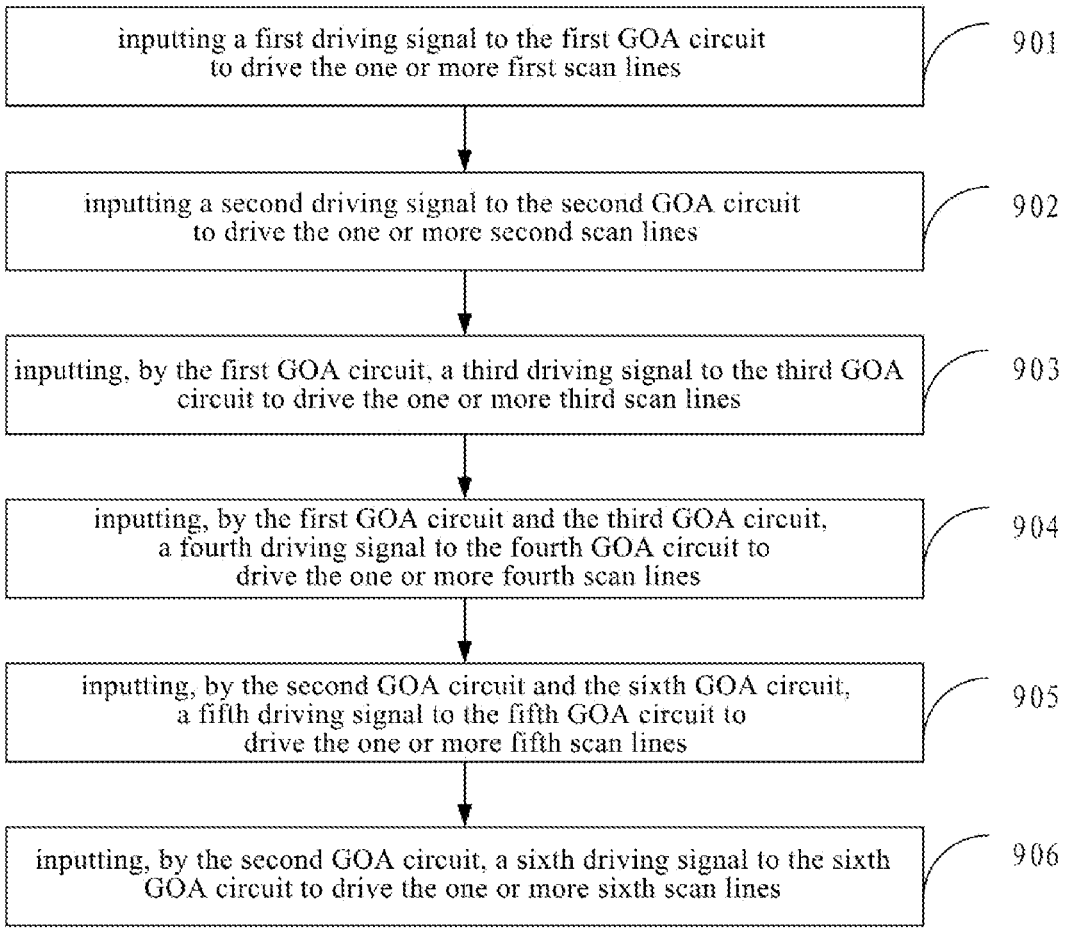
FIG. 9 is a flow chart showing steps of a second gate driving method in which an irregular-shaped display panel includes a first irregular-shaped display area and a second irregular-shaped display area, provided in a further embodiment of the present disclosure.

When the first driving module includes the first GOA circuit, the third GOA circuit and the fourth GOA circuit, and the second driving module includes the second GOA circuit, the fifth GOA Circuit and the sixth GOA circuit, and when the gate driving circuit is one as shown in FIG. 4, a corresponding gate driving method may include the following steps as shown in FIG. 9:

step 901: inputting a first driving signal to the first GOA circuit to drive the one or more first scan lines;

step 902: inputting a second driving signal to the second GOA circuit to drive the one or more second scan lines;

step 903: inputting, by the first GOA circuit, a third driving signal to the third GOA circuit to drive the one or more third scan lines;

step 904: inputting, by the first GOA circuit and the third GOA circuit, a fourth driving signal to the fourth GOA circuit to drive the one or more fourth scan lines;

step 905: inputting, by the second GOA circuit and the sixth GOA circuit, a fifth driving signal to the fifth GOA circuit to drive the one or more fifth scan lines; and step 906: inputting, by the second GOA circuit, a sixth driving signal to the sixth GOA circuit to drive the one or more sixth scan lines.

For specific gate driving methods and operation processes, reference may be made to the foregoing embodiments of the gate driving circuit, and details are not described herein again.

According to another embodiment of the present disclosure, there is further provided an array substrate that includes the gate driving circuit as described in any of the above embodiments.

According to a further embodiment of the present disclosure, there is further provided a display device that includes the gate driving circuit as described in any of the above embodiments.

The present application provides the gate driving circuit and its driving method, the array substrate and the display device. The gate driving circuit is used for driving the irregular-shaped display panel which includes the regular-shaped display area and the first irregular-shaped display area. The regular-shaped display area includes the one or more first scan lines and the one or more second scan lines arranged alternately in the column direction. The first irregular-shaped display area includes the one or more third scan lines and the one or more fourth scan lines alternately arranged in the column direction. The gate driving circuit includes the first driving module and the second driving module. The first driving module is configured to drive the one or more first scan lines, and the second deriving module is configured to drive the one or more second scan lines. Moreover, the one or more third scan lines are driven by the first driving module or the second driving module, and the one or more fourth scan lines are driven by the first driving module or the second driving module. With this technical solution, it is possible to allow the manner of non-simultaneous driving on both sides of the regular-shaped display area to be applied to the driving of the first irregular-shaped display area, thereby achieving the full display of the irregular-shaped screen. Moreover, such a manner of driving non-simultaneously on both sides can meet the requirement of the narrow frame design.

The various embodiments in the present specification are described in a progressive manner, and each embodiment focuses on differences from other embodiments. Detailed description of the same or similar parts of the embodiment may be seen from the other embodiments.

Finally, it should be noted that, in the present application, relational terms such as first and second are used only to discriminate one from another entity or operation without necessarily requiring or implying the actual existence of any relation or sequence between these entities or operations. Moreover, the terms "comprise", "include" or any other variants thereof are intended to be not exclusive, in order that the process, method, item or device comprising a series of elements shall encompass not only elements described herein but also other elements that are not listed explicitly, or further encompass the inherent elements of this process, method, item or device. Without further limitation, an element defined by the phase "comprising a . . . " does not exclude the presence of additional identical elements in a process, method, item or device that includes the element described herein.

The gate driving circuit and its driving method, the array substrate and the display device provided in the present disclosure have been described in detail. In the present application, the specific embodiments are provided to describe the principle and the implementations of the present application. The descriptions of the embodiments as above are used only to help understanding the methods and main concept of the present application; meanwhile, modifications may be made by an ordinary person skilled in the art according to the concept of the present application within the scope of specific embodiments and applications. Therefore, the contents of the specification should not be constructed as any limitation on the present application.

What is claimed is:

1. A gate driving circuit for driving an irregular-shaped display panel, the irregular-shaped display panel comprising a regular-shaped display area and a first irregular-shaped display area, wherein the regular-shaped display area comprises one or more first scan lines and one or more second scan lines alternately arranged in a column direction, and the first irregular-shaped display area comprises one or more third scan lines and one or more fourth scan lines alternately arranged in the column direction; and the gate driving circuit comprising a first driving module configured to drive the one or more first scan lines and a second driving module configured to drive the one or more second scan lines;

wherein the one or more third scan lines are driven by the first driving module or the second driving module, and the one or more fourth scan lines are driven by the first driving module or the second driving module, wherein the first driving module comprises a first Gate on Array (GOA) circuit configured to drive the one or more first scan lines and a third GOA circuit configured to drive the one or more third scan lines, and wherein the second driving module comprises a second GOA circuit configured to drive the one or more second scan lines and a fourth GOA circuit configured to drive the one or more fourth scan lines;

wherein the first GOA circuit and the third GOA circuit each comprise a plurality of GOA units cascaded with each other, wherein a signal input terminal of a first level GOA unit of the third GOA circuit is connected to a signal output terminal of the last level GOA unit of the first GOA circuit, and a signal output terminal of the first level GOA unit of the third GOA circuit is connected to a reset terminal of the last level GOA unit of the first GOA circuit;

wherein the second GOA circuit and the fourth GOA circuit each comprise a plurality of GOA units cascaded with each other, wherein a signal input terminal of a first level GOA unit of the fourth GOA circuit is connected to a signal output terminal of the last level GOA unit of the second GOA circuit, and a signal output terminal of the first level GOA unit of the fourth GOA circuit is connected to a reset terminal of the last level GOA unit of the second GOA circuit; and wherein the first GOA circuit is sequentially connected to the third GOA circuit and the fourth GOA circuit.

2. The gate driving circuit according to claim 1, wherein the one or more first scan lines are arranged in one or more odd-numbered rows of the regular-shaped display area, and the one or more second scan lines are arranged in one or more even-numbered rows of the regular-shaped display area; and the one or more third scan lines are arranged in one or more odd-numbered rows of the first irregular-shaped display region, and the one or more fourth scan lines are arranged in one or more even-numbered rows of the first irregular-shaped display region.

3. The gate driving circuit according to claim 1, wherein:

the first GOA circuit and the third GOA circuit are connected to a first CLK signal line, and the second GOA circuit and the fourth GOA circuit are connected to a second CLK signal line.

4. The gate driving circuit according to claim 1, wherein:

arranging alternately in the column direction comprises arranging alternately each row of the first scan line and each row of the second scan line in the column direction, and arranging alternately each row of the third scan line and each row of the fourth scan line in the column direction.

5. The gate driving circuit according to claim 1, wherein arranging alternately in the column direction comprises arranging alternately every two rows of the first scan lines and every two rows of the second scan lines in the column direction, and arranging alternately every two rows of the third scan lines and every two rows of the fourth scan lines in the column direction.

6. The gate driving circuit according to claim 1, wherein the irregular-shaped display panel further comprises a second irregular-shaped display area that comprises one or more fifth scan lines and one or more sixth scan lines alternately arranged in the column direction, wherein the one or more fifth scan lines are driven by the first driving module or the second driving module, and the one or more sixth scan lines are driven by the first driving module or the second driving module.

7. The gate driving circuit according to claim 6, wherein the one or more fifth scan lines are one or more scan lines in one or more odd-numbered rows of the second irregular-shaped display area, and the one or more sixth scan lines are one or more scan lines in one or more even-numbered rows of the second irregular-shaped display areas.

8. A gate driving circuit for driving an irregular-shaped display panel, the irregular-shaped display panel comprising a regular-shaped display area and a first irregular-shaped display area, wherein the regular-shaped display area comprises one or more first scan lines and one or more second scan lines alternately arranged in a column direction, and the first irregular-shaped display area comprises one or more third scan lines and one or more fourth scan lines alternately arranged in the column direction; and the gate driving circuit comprising a first driving module configured to drive the one or more first scan lines and a second driving module configured to drive the one or more second scan lines;

wherein the one or more third scan lines are driven by the first driving module or the second driving module, and the one or more fourth scan lines are driven by the first driving module or the second driving module, wherein the irregular-shaped display panel further comprises a second irregular-shaped display area that comprises one or more fifth scan lines and one or more sixth scan lines alternately arranged in the column direction, wherein the one or more fifth scan lines are driven by the first driving module or the second driving module, and the one or more sixth scan lines are driven by the first driving module or the second driving module, wherein the first driving module comprises a first GOA circuit configured to drive the one or more first scan lines, a third GOA circuit configured to drive the one or more third scan lines and a fifth GOA circuit configured to drive the one or more fifth scan lines; and the second driving module comprises a second GOA circuit configured to drive the one or more second scan lines, a fourth GOA circuit configured to drive the one or more fourth scan lines and a sixth GOA circuit configured to drive the one or more sixth scan lines;

wherein the first GOA circuit, the third GOA circuit and the fifth GOA circuit each comprise a plurality of GOA units cascaded with each other; wherein a signal input terminal of a first level GOA unit of the third GOA circuit is connected to a signal output terminal of the last level GOA unit of the first GOA circuit; a signal output terminal of the first level GOA unit of the third GOA circuit is connected to a reset terminal of the last level GOA unit of the first GOA circuit; a signal input terminal of a first level GOA unit of the fifth GOA circuit is connected to a signal output terminal of the last level GOA unit of the third GOA circuit; and a signal output terminal of the first level GOA unit of the fifth GOA circuit is connected to a reset terminal of the last level GOA unit of the third GOA circuit; and wherein the second GOA circuit, the fourth GOA circuit and the sixth GOA circuit each comprise a plurality of GOA units cascaded with each other; wherein a signal input terminal of a first level GOA unit of the sixth GOA circuit is connected to a signal output terminal of the last level GOA unit of the second GOA circuit; and a signal output terminal of the first level GOA unit of the sixth GOA circuit is connected to a reset terminal of the last level GOA unit of the second GOA circuit; a signal input terminal of a first level GOA unit of the fourth GOA circuit is connected to a signal output terminal of the last level GOA unit of the sixth GOA circuit; and a signal output terminal of the first level GOA unit of the fourth GOA circuit is connected to a reset terminal of the last level GOA unit of the sixth GOA circuit.

9. A gate driving circuit for driving an irregular-shaped display panel, the irregular-shaped display panel comprising a regular-shaped display area and a first irregular-shaped display area, wherein the regular-shaped display area comprises one or more first scan lines and one or more second scan lines alternately arranged in a column direction, and the first irregular-shaped display area comprises one or more third scan lines and one or more fourth scan lines alternately arranged in the column direction; and the gate driving circuit comprising a first driving module configured to drive the one or more first scan lines and a second driving module configured to drive the one or more second scan lines;

wherein the one or more third scan lines are driven by the first driving module or the second driving module, and the one or more fourth scan lines are driven by the first driving module or the second driving module, wherein the irregular-shaped display panel further comprises a second irregular-shaped display area that comprises one or more fifth scan lines and one or more sixth scan lines alternately arranged in the column direction, wherein the one or more fifth scan lines are driven by the first driving module or the second driving module, and the one or more sixth scan lines are driven by the first driving module or the second driving module, wherein the first driving module comprises a first GOA circuit configured to drive the one or more first scan lines, a third GOA circuit configured to drive the one or more third scan lines and a fourth GOA circuit configured to drive the one or more fourth scan lines; and the second driving module comprises a second GOA circuit configured to drive the one or more second scan lines, a sixth GOA circuit configured to drive the one or more sixth scan lines and a fifth GOA circuit configured to drive the one or more fifth scan lines;

wherein the first GOA circuit, the third GOA circuit and the fourth GOA circuit each comprise a plurality of GOA units cascaded with each other; wherein a signal input terminal of a first level GOA unit of the third GOA circuit is connected to a signal output terminal of the last level GOA unit of the first GOA circuit; a signal output terminal of the first level GOA unit of the third GOA circuit is connected to a reset terminal of the last level GOA unit of the first GOA circuit; a signal input terminal of a first level GOA unit of the fourth GOA circuit is connected to a signal output terminal of the last level GOA unit of the third GOA circuit; and a signal output terminal of the first level GOA unit of the fourth GOA circuit is connected to a reset terminal of the last level GOA unit of the third GOA circuit; and wherein the second GOA circuit, the fifth GOA circuit and the sixth GOA circuit each comprise a plurality of GOA units cascaded with each other; a signal input terminal of a first level GOA unit of the sixth GOA circuit is connected to a signal output terminal of the last level GOA unit of the second GOA circuit; a signal output terminal of the first level GOA unit of the sixth GOA circuit is connected to a reset terminal of the last level GOA unit of the second GOA circuit; a signal input terminal of a first level GOA unit of the fifth GOA circuit is connected to a signal output terminal of the last level GOA unit of the sixth GOA circuit; and a signal output terminal of the first level GOA unit of the fifth GOA circuit is connected to a reset terminal of the last level GOA unit of the sixth GOA circuit.

10. The gate driving circuit according to claim 9, wherein:

the first GOA circuit, the third GOA circuit, and the fourth GOA circuit are connected to a first CLK signal line; and the second GOA circuit, the fifth GOA circuit, and the sixth GOA circuit are connected to a second CLK signal line.

11. The gate driving circuit according to claim 6, wherein:

arranging alternately in the column direction comprises arranging alternately each row of the fifth scan line and each row of the sixth scan line in the column direction.

12. The gate driving circuit according to claim 6, wherein:

arranging alternately in the column direction comprises arranging alternately every two rows of the fifth scan lines and every two rows of the sixth scan lines in the column direction.

13. An array substrate comprising a gate driving circuit for driving an irregular-shaped display panel according to claim 1.

14. The array substrate according to claim 13, wherein the one or more first scan lines are one or more scan lines in one or more odd-numbered rows of the regular-shaped display area, and the one or more second scan lines one or more scan lines in one or more even-numbered rows of the regular-shaped display area; and the one or more third scan lines are one or more scan lines in one or more odd-numbered rows of the first irregular-shaped display region, and the one or more fourth scan lines are one or more scan lines in one or more even-numbered rows of the first irregular-shaped display region.

15. The array substrate according to claim 13, wherein the irregular-shaped display panel further comprises a second irregular-shaped display area that comprises one or more fifth scan lines and one or more sixth scan lines alternately arranged in the column direction, wherein the one or more fifth scan lines are driven by the first driving module or the second driving module, and the one or more sixth scan lines are driven by the first driving module or the second driving module.

16. A display device comprising the array substrate according to claim 13.

17. A gate driving method for a gate driving circuit configured to drive an irregular-shaped display panel according to claim 1, the method comprising:

inputting a driving signal to each of the first driving module and the second driving module;

driving the one or more first scan lines and the one or more second scan lines of the regular-shaped display area to scan; and driving the one or more third scan lines and the one or more fourth scan lines of the first irregular-shaped display area to scan.

18. The gate driving method according to claim 17, wherein the irregular-shaped display panel further comprises a second irregular-shaped display area that comprises one or more fifth scan lines and one or more sixth scan lines alternately arranged in the column direction, the method further comprising:

driving the one or more fifth scan lines and the one or more sixth scan lines of the second irregular-shaped display area to scan.

* * * * *